United States Patent [19]

Decaux

[11] 4,168,039

[45] Sep. 18, 1979

[54] DEVICE FOR COMPENSATING FOR THE OFFSET OF A SHEET ELEMENT ON ROLLERS, IN PARTICULAR FOR A POSTER BOARD HAVING MOVING POSTERS

[76] Inventor: Jean-Claude Decaux, 53 Av. du Mal Lyautey, 75016 Paris, France

[21] Appl. No.: 956,615

[22] Filed: Nov. 1, 1978

[30] Foreign Application Priority Data

Nov. 8, 1977 [FR] France ..... 77 33546

[51] Int. Cl.[2] ..... B65H 25/26

[52] U.S. Cl. ..... 242/57.1; 226/19

[58] Field of Search ..... 242/57.1, 57, 67.4; 226/18, 19, 20, 21, 22, 23

[56] References Cited

U.S. PATENT DOCUMENTS

| | | | |
|---|---|---|---|
| 2,239,472 | 4/1941 | Stanford | 242/57.1 |
| 2,779,549 | 1/1957 | Teplitz | 242/57.1 |
| 3,156,426 | 11/1964 | Brock | 242/57.1 X |
| 3,323,740 | 6/1967 | Blessing | 242/57.1 |
| 3,380,637 | 4/1968 | Knapp | 226/20 |

*Primary Examiner*—Edward J. McCarthy

*Attorney, Agent, or Firm*—Lowe, Kokjer, Kircher, Wharton & Bowman

[57] ABSTRACT

The device compensates for the offset of a sheet element which is movably mounted on at least two parallel rollers which are alternately supply and receiving rollers. At least one (1) of these rollers is inclinable relative to the other and is controlled by means (17–20) for detecting the offset of the sheet element and acting on compensating means (3–12) which modify the angle of the inclinable roller. This device comprises an offset compensating member (3) which normally rotates with the inclinable roller when the sheet element is correctly centered. The rotation of the compensating member is temporarily interrupted and converted into a linear displacement by the action of at least one abutment (9) which is shifted by the detecting means when the latter detects an offset of the sheet element. The compensating means cooperates, in its linear displacement, with the profile of a cam (12) which modifies the position of one end of the inclinable roller and consequently the angle of the latter.

The invention is applicable to the control of the offset of any element in the form of a sheet or band held taut on two rollers or reels.

11 Claims, 5 Drawing Figures

DEVICE FOR COMPENSATING FOR THE OFFSET OF A SHEET ELEMENT ON ROLLERS, IN PARTICULAR FOR A POSTER BOARD HAVING MOVING POSTERS

The invention relates to a device for compensating for the offset of a sheet or band element mounted on reels or rollers of utility in particular in the field of moving poster boards.

In this type of board, such as that described in French Patent Application No. 76 17 326 of June 9, 1976 filed by the Applicant, the moving poster is rolled by both ends on a roller which becomes alternately a receiving roller and a supply roller, and the possible lateral offset of the poster is detected and compensated for respectively by photoelectric cells which read the edges of the posters and by at least one screw jack driven by a motor which is controlled by the end of one of two rollers which is mounted to be inclinable in a swivel bearing.

This type of compensating device is effective but has the drawback of being relatively expensive, since it employs many costly components (photoelectric cells and their signal processing circuits, motor, transmission means, screw jack, etc.) which considerably increases the price of the poster board. The invention therefore relates to a device for compensating for the possible offset of the poster on its rollers which avoids the use of photoelectric cells, the motor and the screw jack, while it permits a reliable and effective detection of, and compensation for, this offset.

According to the invention, there is provided a device for compensating for the offset of a sheet or band element which is mounted to move on at least two parallel rollers which are alternately supply and receiving rollers, at least one of said rollers being angularly movable relative to the other roller and being controlled by means for detecting the offset of the sheet element acting on compensating means which modify the angle of the inclinable roller, said device comprising an offset compensating means which is normally movable in rotation with the inclinable roller with which it is coupled (when the sheet element is correctly centred), the rotation of said means being temporarily interrupted and converted into a linear displacement by the intervention of at least one abutment which is controlled by the detecting means upon the offsetting of the sheet element, the compensating means cooperating in its movement in translation with the profile of a cam which modifies the angle of the inclinable roller.

In one embodiment, the offset compensating means comprises a tapped sleeve which is coupled with the screwthreaded end of the inclinable roller and is journalled in a bearing provided with at least one finger member capable of sliding on an inclined ramp, said sleeve comprising on the periphery thereof recesses which cooperate with the moving part of an electromagnetic mechanism controlled by the detecting means.

In a modification, the sleeve is frustoconical with outer axial grooves which open onto the two end faces of the sleeve, the electromagnetic mechanism being fixed and comprising two plungers which reverse the direction of displacement in translation of the sleeve by the cooperation of either of the two plungers with one of the grooves.

A better understanding of the invention will be had from the ensuing description with reference to the accompanying drawings in which.

The device according to the invention is adapted to compensate for the offset of a sheet-shaped element which is held taut on cylinders (reels or rollers). This element can be in the form of a sheet, band or a poster.

Thus, this device may have many applications, although the example which will now be described concerns poster boards having moving posters.

This type of poster board usually comprises a set of two parallel reels mounted on a frame and a poster band which is rolled at each end around each reel and is capable of unrolling from one of the reels, which becomes a supply reel, and rolling onto the other reel, which becomes the receiving reel. It will be understood that the reels are provided with driving means for rotating them when they become receiving reels.

Figure 1:
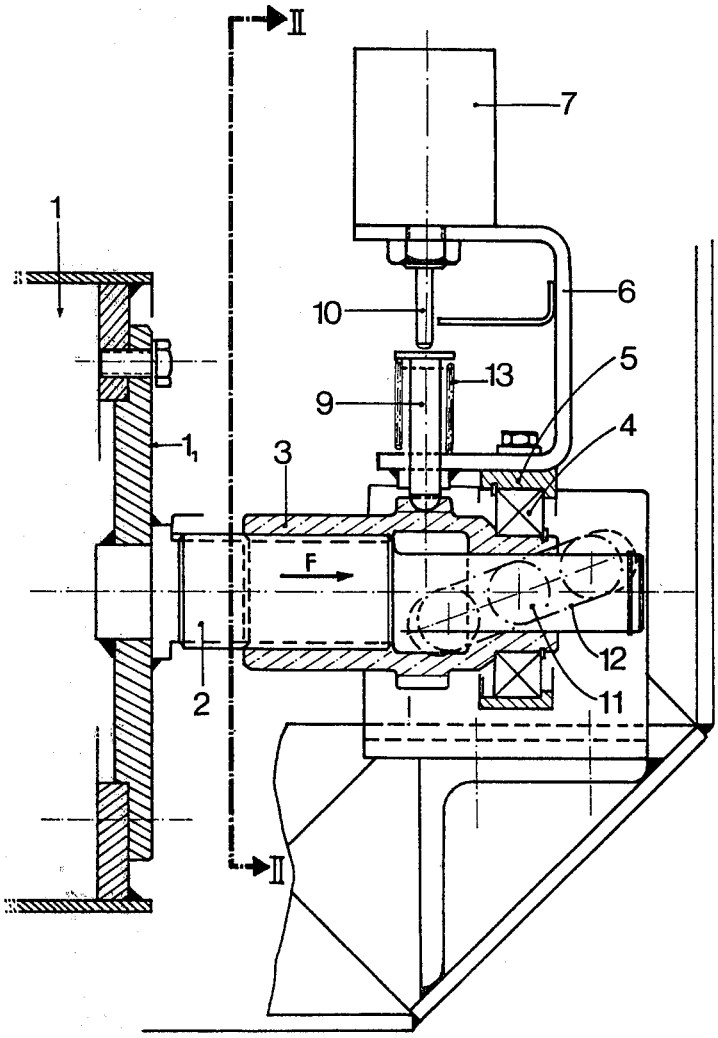
FIG. 1 is an elevational view, partly in section, of the end of a roller provided with the offset compensating device.

FIG. 1 illustrates one of the two rollers 1 one end of which is shown, to which end the poster offset compensating device of the invention is coupled.

The end face $1_1$ of the roller comprises a screwthreaded end member 2 which is welded on the axis of the roller, this end member receiving a tapped sleeve 3 which is screwthreadily engaged on the end member.

This sleeve has a substantially cylindrical shape and is surrounded by a ball bearing 4 the outer ring 5 of which supports a member 6 for fixing electromagnetic means, for example an electromagnet. The sleeve 3 has cup-shaped recesses 8 cooperating with an abutment 9 controlled by the plunger 10 of the electromagnet 7.

Each of the side faces $5_1$–$5_2$ is provided (FIG. 2) with a projecting finger member 11 which slides on a cam, for example, an inclined ramp $12_1$, $12_2$.

This device operates in the following manner:

As long as the poster or band held taut on the rollers is perfectly centred, which is controlled by the detecting means which will be described hereinafter, the sleeve 3 coupled to the roller 1 rotates with this roller at the same speed owing to friction between the screwthreads of the sleeve and the screwthreaded end member 2. In this case, the electromagnet 7 is not excited and its plunger is withdrawn so that the abutment 9, which is in contact with the plunger, is also withdrawn under the effect of its return spring 13.

Consequently, the sleeve 3 is free to rotate in its bearing 4.

As soon as the poster is sufficiently offset to bring into action the detecting means, the electromagnet 7 is excited and its plunger 10 exerts an axial thrust on the abutment 9 which comes in contact with the periphery of the sleeve 3 until it encounters a recess 8 and prevents the sleeve from rotating.

It will be understood that this abutment 9 is located in the radial plane of the sleeve in which the recesses 8 are arranged and the depth of these recesses is sufficient to enable the abutment 9 to act as a true stopping lock.

Figure 2:
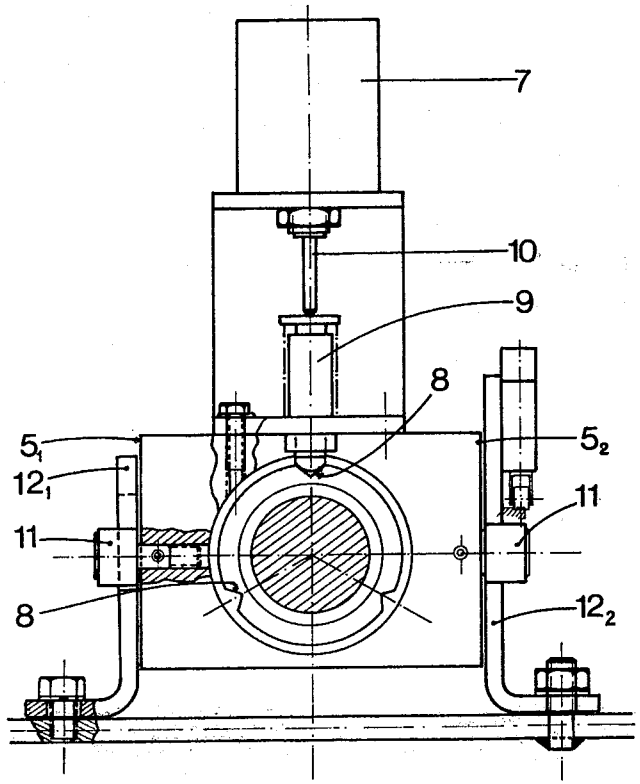
FIG. 2 is a sectional view, taken on line II—II of FIG. 1, with parts cut away.

FIGS. 1 and 2 represent the device when the electromagnet 7 is excited and the sleeve 3 is prevented from rotating. This abutment 9 is in fact adapted to convert the rotating motion of the sleeve 3 into a linear motion, the sleeve being supplied with energy by the very rotation of the roller 1. Indeed, as the sleeve 3 is prevented from rotating and the roller 1 continues to rotate, this sleeve will necessarily move axially in the direction of the arrow F (FIG. 1) by the action of the screwthreads. Now, as this sleeve 3 is under the action of the abutment 9 rigid with the ball bearing 4 and the magnetic means assembly, this movable unit will move, under the effect of the finger members 11, along the fixed and inclined ramps 12 of the frame and thereby produce a slight inclination of the roller 1.

This roller 1 is of course retained at its other end by a ball bearing having a deep groove, preferably on a swivel bearing, so that this roller can be inclined without moving axially.

Figure 3:
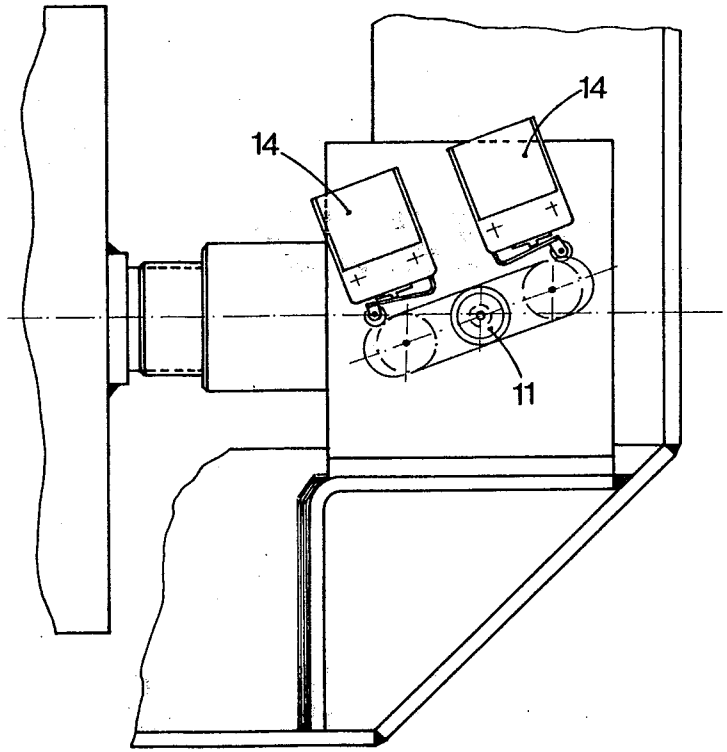
FIG. 3 is an elevational view of end-of-travel microswitches.

The displacement of the sleeve 3, connected to the roller 1, relative to the inclined plane 12 is of course of short duration since the taking up or compensation of the offset requires only a relatively small inclination. However, as shown in FIG. 3, end-of-travel microswitches 14 are provided for interrupting the excitation of the electromagnet and releasing the sleeve 3 when the finger member 11 comes in contact with either of the two switches. If either of the two switches fails, the shape of the recesses and the force exerted by the electromagnet are so arranged that, at the end of the travel, the sleeve urges the abutment 9 out of the recess so that the sleeve can again rotate without impairing the component parts. In particular, the recesses have a V-shaped cross section.

It is important to note that the direction of the correction of the inclination must be related to the direction of the offset. Consequently, the electromagnet must only be excited when the direction of the unrolling of the poster corresponds to the required direction of correction. A small electronic logic is provided to determine this condition.

In a modification of the invention (FIG. 5), the sleeve 3 may have a frustoconical shape and in this case, half of its apex angle is equal to the inclination of the oblique ramp 15 which is defined by an oblong aperture in the presently-described embodiment.

In this embodiment, the nut has, as illustrated in FIG. 2, recesses 8, provided that the latter are not in the form of short or point cavities but in the form of grooves which extend throughout the length of the sleeve 3 and open onto the two faces $3_1$, $3_2$. Here again, the number and the depth of the grooves 8 are so calculated as to permit an immobilization of the sleeve as concerns rotation as mentioned before with reference to FIG. 1.

In this modification, the electromagnet 7 is rigid with the frame and has two plungers 16 which are contained in the same axial plane of the sleeve but offset longitudinally. These plungers are alternately operative, depending on the direction of rotation of the roller 1 and consequently the sleeve 3. Indeed, it must be recalled that the roller 1 rotates alternately in one direction and then the other, depending on whether it is a supply roller or a receiving roller, this alternating rotation being produced by a reversible motor.

Thus, and in the event of an offset of the poster, ascertained by the detecting means operative on one of the edges of the poster, one of the two plungers 16 is engaged in one of the grooves 8 of the frustoconical sleeve at the moment when the direction of rotation of the roller is such that the sleeve, thus prevented from rotation, moves, under the action of its screwthread, along the axis and slides along the ramp 15 which modifies the inclination of the roller in the required direction. At the end of the travel, the plunger escapes from the end of the groove 8 so that no locking is possible.

The roller is returned to the initial position by the second plunger which is responsive to the opposite direction of rotation and stops the sleeve from rotating, as explained hereinbefore, and then escapes at the end of the travel from the groove 8 when it is urged by the second detecting means of the other edge.

Figure 5:
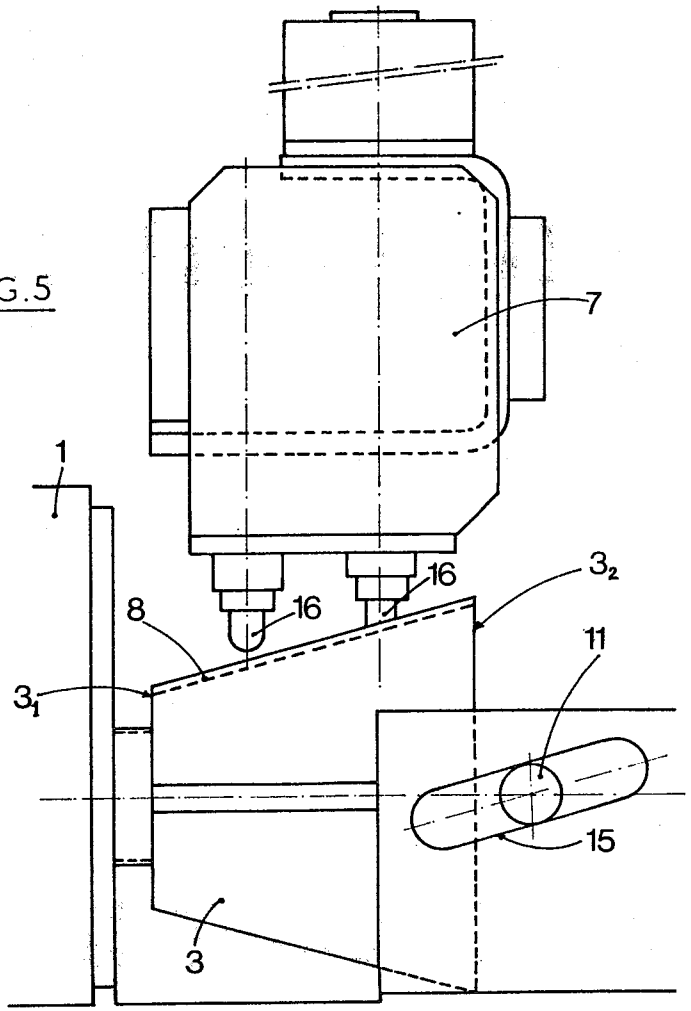
FIG. 5 is an elevational view of a modification.
Figure 4:
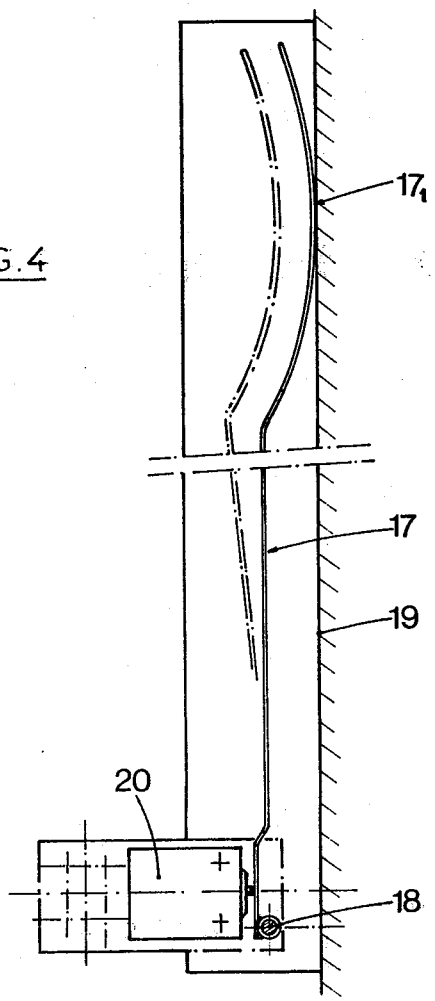
FIG. 4 is an elevational view of the poster offset detecting means.

Whether it concerns the embodiment shown in FIG. 1 or the modification shown in FIG. 5, the electromagnetic means 7 are preferably controlled by two detecting means such as that shown in FIG. 4. These means comprise a flexible blade 17 pivotably mounted on a pin 18, the free end $17_1$ of this blade bearing against the edge 19 of the poster.

The end of the blade adjacent the pivotably mounted end is in contact with a microswitch 20 and the coefficient of hysteresis of the assembly comprising the blade and the microswitch is so designed that the microswitch is actuated only when a minimum poster offset threshold is reached.

This poster offset compensating device has the advantage of dispensing with the photoelectric cells or the screw jacks which were heretofore employed for taking up this offset.

It must be understood that the invention is not intended to be limited to the embodiments described hereinbefore, since other forms and other embodiments of the invention may be envisaged without departing from the scope of the invention defined in the claims.

I claim:

1. A device for compensating for the offset of an element in the form of a sheet or band which is rollably mounted on at least two rollers which are normally parallel and are alternately supply rollers and receiving rollers, at least one of the rollers being inclinable so as to be angularly movable relative to the other roller, said device comprising means associated with the element for detecting the offset of the element, means associated with the inclinable roller for modifying the angle of the inclinable roller relative to said other roller, means connecting the compensating means to the inclinable roller and operative to normally cause the compensating means to be rotated by the inclinable roller but to displace the compensating means linearly when the compensating means is prevented from rotating, abutment means cooperative with the compensating means and movable between an inoperative position and an operative position in which operative position the abutment means prevents rotation of the compensating means, the detecting means being operatively connected to the abutment means to move the abutment means to said operative position thereof when the detecting means detects an offset of said element, and cam surface means cooperative with the compensating means when the compensating means is displaced linearly so as to change the angle of the inclinable roller relative to said other roller and thereby compensate for the offset.

2. A device as claimed in claim 1, wherein the compensating means comprise means defining a screwthread adjacent an end of the inclinable roller, a sleeve having an internal screwthread screwthreadedly engaged with the screwthread adjacent the end of the inclinable roller, a bearing in which the sleeve is journalled, a finger member carried by the sleeve and cooperable with the cam surface means, recess means in the sleeve, the abutment means being engageable in the recess means in said operative position thereof, an electromagnetic mechanism, an electric circuit operatively connecting the detecting means to the electromagnetic mechanism, and the electromagnetic mechanism having a moving part which comprises the abutment means whereby upon detection of said offset by the detecting means, the electromagnetic mechanism shifts the abutment means to said operative position thereof.

3. A device as claimed in claim 1, wherein the bearing is a rolling bearing having an outer ring, and two opposed finger members are carried by the outer ring, the cam surface means comprising two inclined ramps on which ramps the two finger members are movable, said outer ring carrying the electromagnetic mechanism, which mechanism comprises an electromagnet having a plunger, a connecting member, and elastically yieldable means applying the connecting member against the plunger.

4. A device as claimed in claim 3, wherein the connecting member constitutes said abutment means which is movable by the plunger in opposition to the action of the elastically yieldable means.

5. A device as claimed in claim 1, wherein said cam surface means comprise means defining an inclined oblong slot.

6. A device as claimed in any one of the claims 1, 2 or 3, comprising two microswitches which are cooperative with the compensating means and are part of electrical end-of-travel means for said linear displacement in opposite directions.

7. A device as claimed in claim 1, comprising an electromagnetic mechanism having two plungers which constitute said abutment means, the detecting means being electrically operatively connected to the electromagnetic mechanism for bringing one of the plungers to its operative position in one direction of rotation of the inclinable roller and the other of the plungers to its operative position in the opposite direction of rotation of the inclinable roller, the compensating means comprising a frustoconical sleeve provided with axially extending outer grooves which extend the full length of the sleeve and open onto opposite end faces of the sleeve, in which grooves the plungers respectively engage in their operative position.

8. A device as claimed in claim 7, wherein the sleeve has an apex angle which is twice the angle of inclination of an inclined ramp which is defined by an oblong slot and constitutes said cam surface means.

9. A device as claimed in claim 7, wherein the two plungers are contained in a common axial plane of the sleeve and are spaced apart longitudinally of the sleeve, the plungers being capable of escaping from the grooves at the end of the linear displacement of the sleeve.

10. A device as claimed in claim 1, wherein the detecting means comprise a microswitch having a switch actuating part and a flexible strip which has one end portion which is pivotally mounted and an opposite free end portion which bears against the edge of said element, the switch actuating part being in facing relation to the strip.

11. A device as claimed in claim 10, wherein the flexible strip has a coefficient of hysteresis which is such that the strip only engages the switch actuating part beyond a minimum threshold offset of said element.

* * * * *